US007426811B2

(12) United States Patent
Pargätzi

(10) Patent No.: US 7,426,811 B2
(45) Date of Patent: Sep. 23, 2008

(54) METHOD AND CLIP APPARATUS FOR THE CLOSING OF SAUSAGE-SHAPED PACKAGES

(75) Inventor: Max Pargätzi, Gossau (CH)

(73) Assignee: Tipper Tie Alpina AG, Gossau (CH)

( * ) Notice: Subject to any disclaimer, the term of this patent is extended or adjusted under 35 U.S.C. 154(b) by 0 days.

(21) Appl. No.: 11/509,942

(22) Filed: Aug. 25, 2006

(65) Prior Publication Data

US 2007/0044434 A1 Mar. 1, 2007

(30) Foreign Application Priority Data

Aug. 26, 2005 (EP) ..... 05018562

(51) Int. Cl.
*B65B 51/04* (2006.01)

(52) U.S. Cl. ..... 53/417; 29/243.56; 53/75; 53/138.2; 53/138.4; 72/21.3; 72/21.4; 452/48

(58) Field of Classification Search ..... 53/417, 53/138.2–138.4, 75; 29/243.56, 243.57; 72/21.3, 21.4; 452/48; *B65B 51/04*
See application file for complete search history.

(56) References Cited

U.S. PATENT DOCUMENTS

| | | | | |
|---|---|---|---|---|
| 3,728,773 | A * | 4/1973 | Dobbert | 29/243.57 |
| 3,913,628 | A * | 10/1975 | Keating et al. | 53/138.4 |
| 3,925,139 | A * | 12/1975 | Simmons | 53/75 |
| 5,101,651 | A * | 4/1992 | Yeomans | 72/21.4 |
| 5,168,736 | A * | 12/1992 | Enneper et al. | 72/21.3 |
| 5,271,254 | A * | 12/1993 | Gloe et al. | 72/13.2 |
| 5,937,505 | A * | 8/1999 | Strong et al. | 72/21.4 |
| 6,067,828 | A * | 5/2000 | Bucher et al. | 72/21.4 |
| 6,101,785 | A | 8/2000 | Bienert et al. | 53/138.4 |
| 6,167,677 | B1 * | 1/2001 | Kammler et al. | 53/75 |
| 6,298,635 | B1 | 10/2001 | Bienert et al. | 53/417 |
| 7,024,752 | B2 * | 4/2006 | Imgrut et al. | 72/21.4 |
| 2006/0272374 | A1 | 12/2006 | Meyrahn et al. | 72/21.4 |

FOREIGN PATENT DOCUMENTS

| | | |
|---|---|---|
| DE | 1933066 | 10/1965 |
| EP | 0 268 206 | 5/1988 |
| EP | 0 460 441 A1 | 12/1991 |
| EP | 0 467 020 A1 | 1/1992 |
| EP | 0 900 733 A1 | 8/1998 |
| EP | 1 518 788 A1 | 3/2005 |
| GB | 1179624 | 1/1970 |

OTHER PUBLICATIONS

European Search Report of EP 05018562 Dated Jan. 20, 2006.

* cited by examiner

*Primary Examiner*—Stephen F Gerrity
(74) *Attorney, Agent, or Firm*—McCormick, Paulding & Huber LLP

(57) ABSTRACT

In a clip apparatus (1) with a drive (2, 3) and a control (4), on the holder (6, 7, 17) of one of the clip closing work tools a force measuring device (9) is provided. Based on the measured force and through the control the drive is influenced and in the case of excessively high force values, the clip apparatus is stopped to avoid damage.

20 Claims, 4 Drawing Sheets

METHOD AND CLIP APPARATUS FOR THE CLOSING OF SAUSAGE-SHAPED PACKAGES

CROSS REFERENCE TO RELATED APPLICATIONS

This application claims the priority of European Patent Application 05 018 562.8, which was filed on 26 Aug. 2005 and the entire disclosure of which is incorporated herewith by reference.

BACKGROUND

The invention concerns a dip apparatus for the closing of sausage-shaped packing casings according to the independent patent claims. Further the invention concerns methods for the closing of sausage-shaped packing sleeves by means of clips according to the independent patent claims.

BACKGROUND OF THE INVENTION

The closing of sausages by means of clips of wire in so-called clip machines is known. In the tube shaped packing casings, or the intestines, a filling-free region is formed by squeezing shears into which region the clips are set (the end clip of the preceding sausage and the beginning clip of the following sausage). The closure of the clips is made by means of an upper work tool (stamp) and a lower work tool (die) which finish shape or close the dips. Indeed with different types of sausage, different clips are used, which clips differ from one another in style as well as in size. This requires the change of the work tools on the clip machine and also often the working stroke for the closure of the clips, which occasionally leads to faulty manipulations, and which can lead to a damaging of the work tools and of the clip machine. In EP-A-0 467 020 a hydraulic arrangement is proposed which makes possible a deflection of the stamp if the closing force on the stamp is exceeded. This arrangement has proven itself. It can, however, become subject to damage on its side if the operating person does not correctly adjust the clamp closing height, and if there is no corrected adjustment upon the loosening of the arrangement, so that the clip machine is constantly driven in this loosened range of the arrangement.

SUMMARY OF THE INVENTION

The invention has as its basic object to provide an improved clip apparatus. The invention has further the basic object of providing an improved closure method.

This is achieved with the apparatus according to the independent claims and with the methods according to the independent claims.

Accordingly, so that the effective force between the work tools is measured, it can be determined by way of a boundary value comparison whether the clip machine works in a force range which is disadvantageous or entirely impermissible, and through an influence on the drive, further operation in the disadvantageous or impermissible force range can be avoided.

In a preferred embodiment, a boundary value for the measured closing force is provided and upon reaching it, or as the case may be exceeding it, the initial clip closing cycle is continued to its end since this is still allowable without damaging the work tools or the clip machine. However, at the completion of the clip closing cycle the clip machine is stopped. This takes place preferably at a position that permits the operator to make changes in the work tool height (clip closure height), and preferably a corresponding fault report is indicated. In a further preferred embodiment a further (higher) limit value is provided and upon the reaching of it, the drive is immediately stopped and preferably also driven rearwardly to a certain angular position, in order to unload the work tools and the other machine components. Especially in the case of electric servomotor drives a correspondingly rapid response to the force measurement and to reaching or exceeding of the boundary value is possible without anything further.

The measurement can, for example, be made by way of a proximity sensor or by way of strain measuring strips. In a preferred embodiment a strain measurement is made at a spot on the upper arm or lower arm of the apparatus, which arms carry the work tools, at a spot weakened by a recess. The force can also be directly measured, for example, by a pressure measuring capsule.

BRIEF DESCRIPTION OF THE DRAWINGS

Further details, advantages and uses of the invention will be apparent from the accompanying claims and from the following description based on the drawings. The drawings are:

DESCRIPTION OF THE PREFERRED EMBODIMENTS

Figure 1:
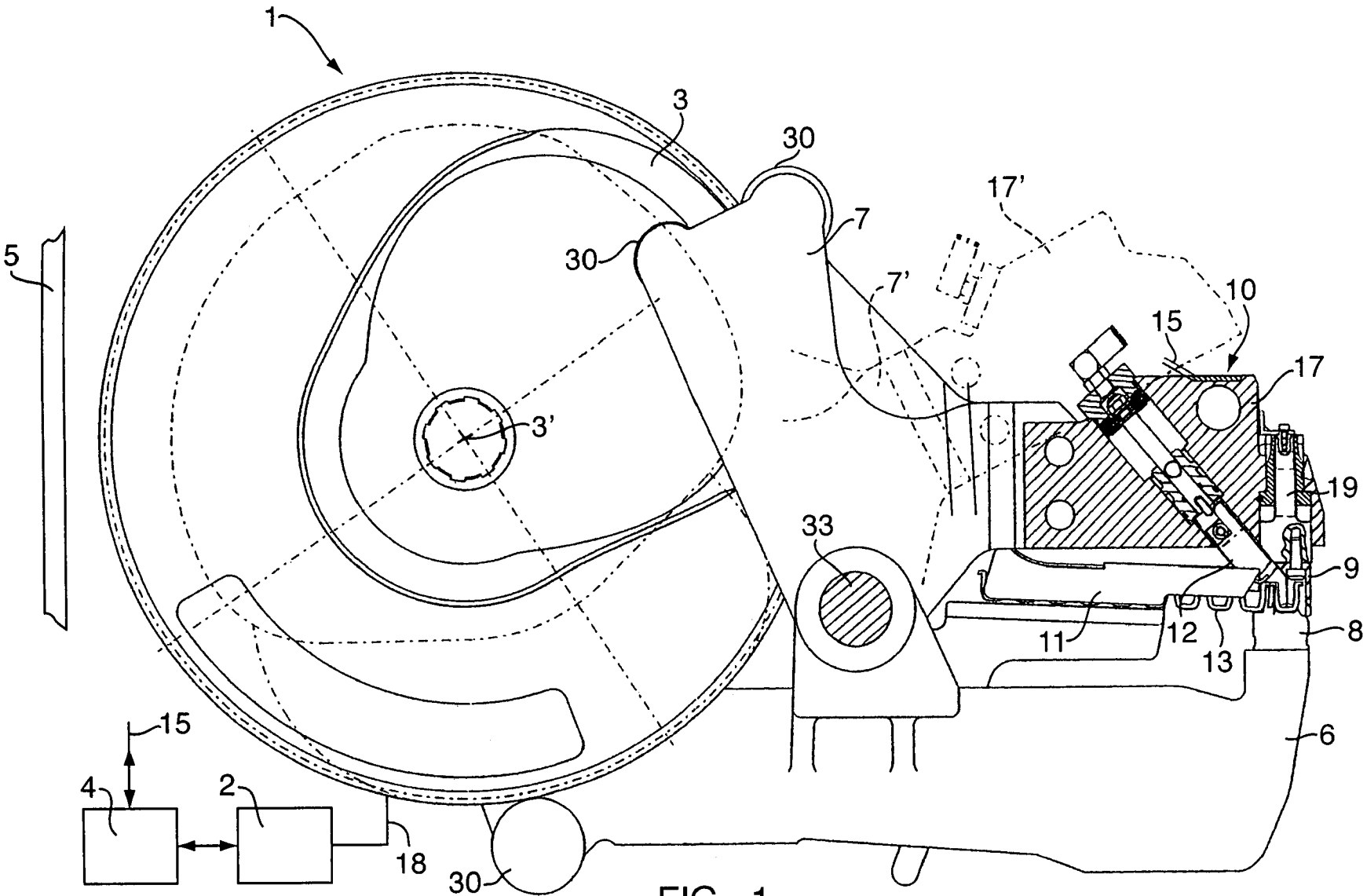
FIG. 1—a partial view of a dip apparatus with an upper arm, a lower arm and drive elements.

FIG. 1 shows a partial illustration of a clip apparatus 1, which in this figure is essentially only illustrated by the upper arm and the lower arm of the apparatus and a portion of the drive elements. The construction of a clip apparatus with the mentioned squeezing shears is however known to the person skilled in the art so that no further explanation of it is necessary beyond that which follows. The clip apparatus 1 has a machine frame and housing 5, shown only enough to indicate its presence, which receives the components of the apparatus and provides the corresponding support locations for the driven elements. In particular, the dip apparatus has a drive 2 which is so constructed that it can be controlled by an electronic control 4. As to this, the drive 2 is especially an electric servomotor drive and the control for it is, for example, an industrial microprocessor based control. The drive 2 works through not more specifically illustrated drive means 18 such as for example belts, chains, gears or other means, on curved discs or actuating cams 3, which are driven by the drive about an axis 3' of rotation. From the control curves of the curved discs and the rollers 30, the lower work tool holder 6 and the upper work tool holder 7, 17 of the clip apparatus are driven in a way known in itself, so that these work tool holders are moved in a path away from one another and toward one another, in order on one hand to allow the passage through them of the filled sausage casing to be closed, and on the other hand to allow the setting of the clips. In the illustrated example, the upper work tool holder 7, 17 which element as a rule is referred to as the upper arm of the clip apparatus, is also partially shown in its open position by the broken lines 7' and 17'. The movement path of the upper arm and of the lower work tool holder 6, usually referred to as the lower arm, are known to persons skilled in the art and need not be here explained in more detail. In a preferred embodiment, the clip part is a preformed clip wire 13, which by way of a clip feeder 11 is delivered to the actual clip dosing work tools 8 and 9. The work tool 8, which can be the die, and the work tool 9, which can be the stamp, are in this case implemented in customary way, so that they first of all cut off from the clip wire a clip-forming segment of the clip wire 13 by dosing the lower arm and the upper arm and then form the clip in its dosed condition. It is further known that a separating knife 12 is provided which can cut the sausage-shaped packages between the two clips set next to one another, that is, the final clip of the previously filled sausage and the initial clip of the subsequently filled sausage, so that individual sausages are obtained. This knife 12 is of course not used if a chain of sausages is to be created. The work tools 8 and 9, for example, the die and stamp, are of such instant kind as to suit the sausages to be made and must accordingly be adjustable in their position to properly cooperate with one another. The die and stamp are, therefore, exchangeable and at least one of these work tools, in this case, the stamp 9, is adjustable in its position with reference to the other work tool, for example, in that the work tool is fastened in an adjustment means 19. This is known and need not be explained in greater detail. In the case of an incorrect adjustment of the so called clip closing height, upon the closing of the lower arm and upper arm for the setting or closing of the involved clip, intolerably high forces can appear, which can lead to damage of the clip apparatus.

According to the present invention a measuring device is used which delivers a measured value of the force appearing upon closure, and by way of the control 4 upon reaching or exceeding a limit value of the force effects the drive 2 to stop the apparatus. In this way, damage to the apparatus can be avoided. In the illustrated example, the measuring device 10 can be arranged on the forward upper arm portion 17. A measuring device can also be arranged on the lower arm or on another part of the work tool holder or it can even be arranged on the work tools 8 and/or 9 themselves, so that in a changing of the work tools, the measuring device is likewise changed. Nevertheless, the preferred arrangement is on the work tool holder 6 or 7/17 and especially on the upper arm 7, 17. A cable 15 leads from the measuring device 10, or else a wireless data connection is used, to the control 4, which connection in FIG. 1 is indicated solely by a piece of cable 15 at the measuring device 10 as well as by an input cable 15 at the control 4. The control 4 can therefore receive from the measuring device the measured value, which is proportional to the force, so that a measurement of the force is provided and the control can compare the magnitude of the force with a pre-established boundary value.

In one embodiment of the clip apparatus, for example, the force for the correct closing of the clip can carry the value 10 kN and from the measuring device a magnitude is measured which corresponds to this force. Then in this example, a first boundary value of 11 kN can be pre-established. Now if the operating person has incorrectly adjusted the position of the work tools 8 and 9 so that upon the closing of the clip the effective force exceeds the correct clip force and the boundary value is reached or exceeded, this can be determined through the control 4 and be used to effect the drive 20 so that the clip apparatus is stopped. Especially in the case of an electric servomotor drive the response time of the drive can be so short that the machine can still be stopped within the same clip closing cycle as that in which the intolerably high force appears; otherwise, the interruption occurs in the next closing cycle. In a more preferred way according to the invention the procedure is such that upon the reaching of the first value, for example, the mentioned boundary value of 11 kN, the clip apparatus finishes the initial dip closing cycle and closes the clip and then by way of the control 4 and the drive 2 the dip apparatus is stopped in a pre-established null position, for example with 7' and 17' at the indicated open position. Also the filling machine for the sausage casing is then stopped, which results from a synchronization signal between the clip apparatus and the filling machine. Further in a still more preferred way, a failure report for the operator is given on the display device of the clip apparatus. The operator is then required to adjust the clip closure height to a suitable value by, for example, adjusting the work tools 8 and 9 accordingly. Thereafter the operator can again set the dip apparatus into operation. If the boundary value is again reached there results a new shut down because of the measured force value and its evaluation through the control.

In a yet further preferred way, a second, higher boundary value is also provided, for example 12 kN, upon the recognition of which an immediate stoppage of the apparatus takes place by means of the measuring device 10 and the control 4. In this case the dip closing cycle is not carried to its end, and instead the cycle is immediately interrupted. Preferably however, thereafter the servo drive is driven backwards by a given angle, in order to unload the work tools and the drive components of the apparatus. After this reverse drive, the apparatus stops and creates again a fault report on the display device. The operator must then correctly adjust the clip closure height by adjusting the one or both work tools, then drive to the null position, which indeed was not attained by the apparatus because of the reaching of the second boundary value, and then the apparatus can be newly started. Should a boundary value be again reached or exceeded, the described process is repeated.

Figure 2:
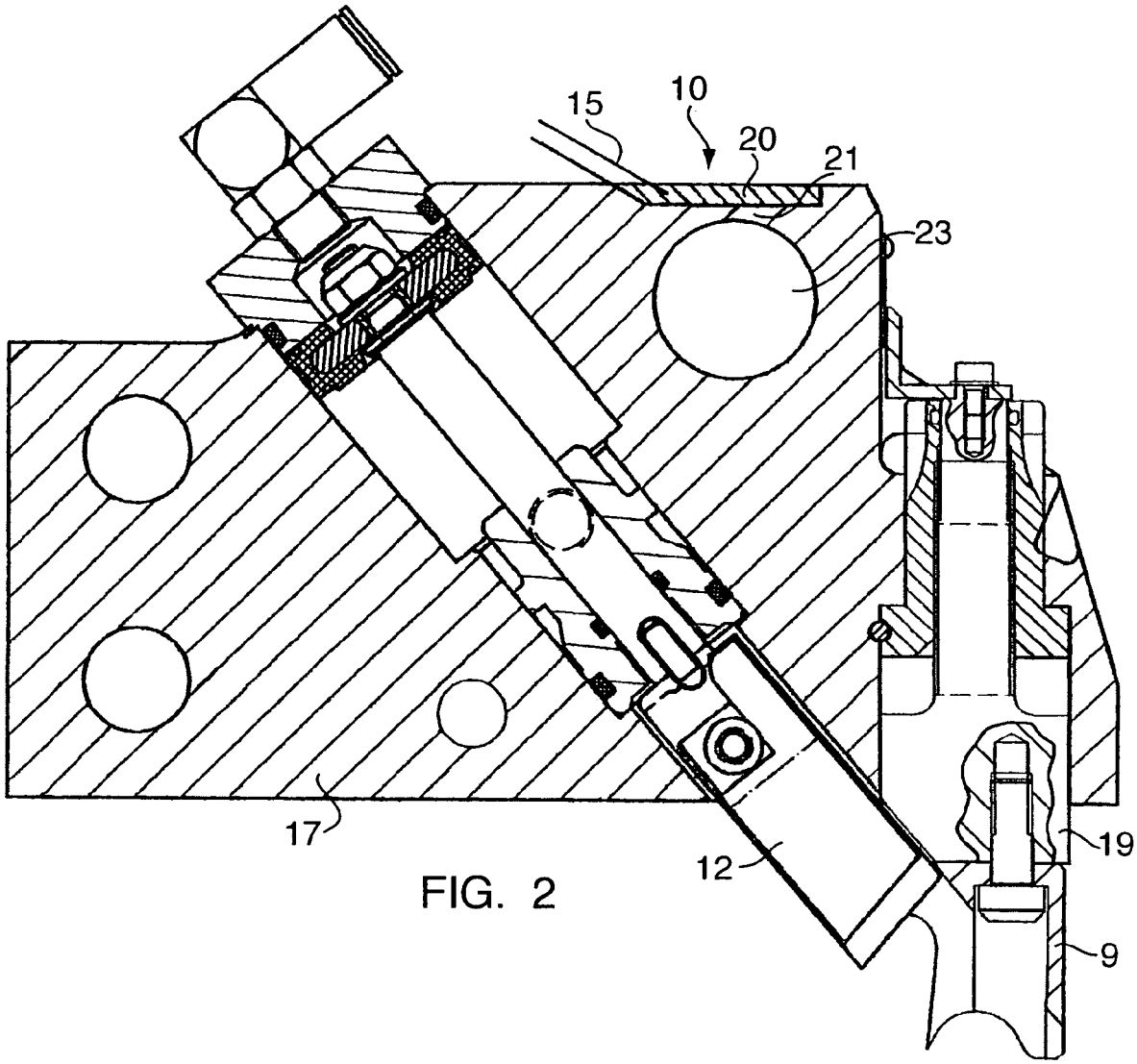
FIG. 2—a view of a portion of the upper arm with a first embodiment of the measuring device.

In the embodiment illustrated in FIG. 1 and FIG. 2 the measuring device 10, as explained, is arranged on the upper arm 7, 17. In the illustrated example on a forward upper arm portion 17 is arranged at least one strain measuring strip 20, especially in a recess in the upper surface of the part 17. The strain measuring strip or the strain measuring strips in case several strips are used, can, for example, be adhesively attached to the part 17 so that a deformation of the same can be determined because of the force appearing upon the closing of the clip. Preferably the measuring device in this case has a region especially intended for deformation in order to be able to dearly determine the force. In the illustrated example of FIGS. 1 and 2 such region 21 is provided beneath the strain measuring strip 20, which is weakened by a recess 23, so that the clip closing force creates a readily measurable deformation (compression) of the area 21. This is determined in a known way by the strain-measuring strip 20 and sent to the control over the transmission means 15, whereby the control evaluates the signal of the strain-measuring strip. Such strain measuring strips and the evaluation of their signals are well known to persons skilled in the art and need not be explained here in greater detail. The output of the signals of the strain measuring strips directly to the control 4 is naturally to be understood as only exemplary, for by all means, a separate circuit could be provided which evaluates the analog signal of the strain measuring strip and provides it in an evaluated form to the control 4, for example, directly as a digital signal. This circuit can also be located directly at the strain measuring strips so that a pre-processed signal is transmitted to the control over the conductor 15.

Figure 3:
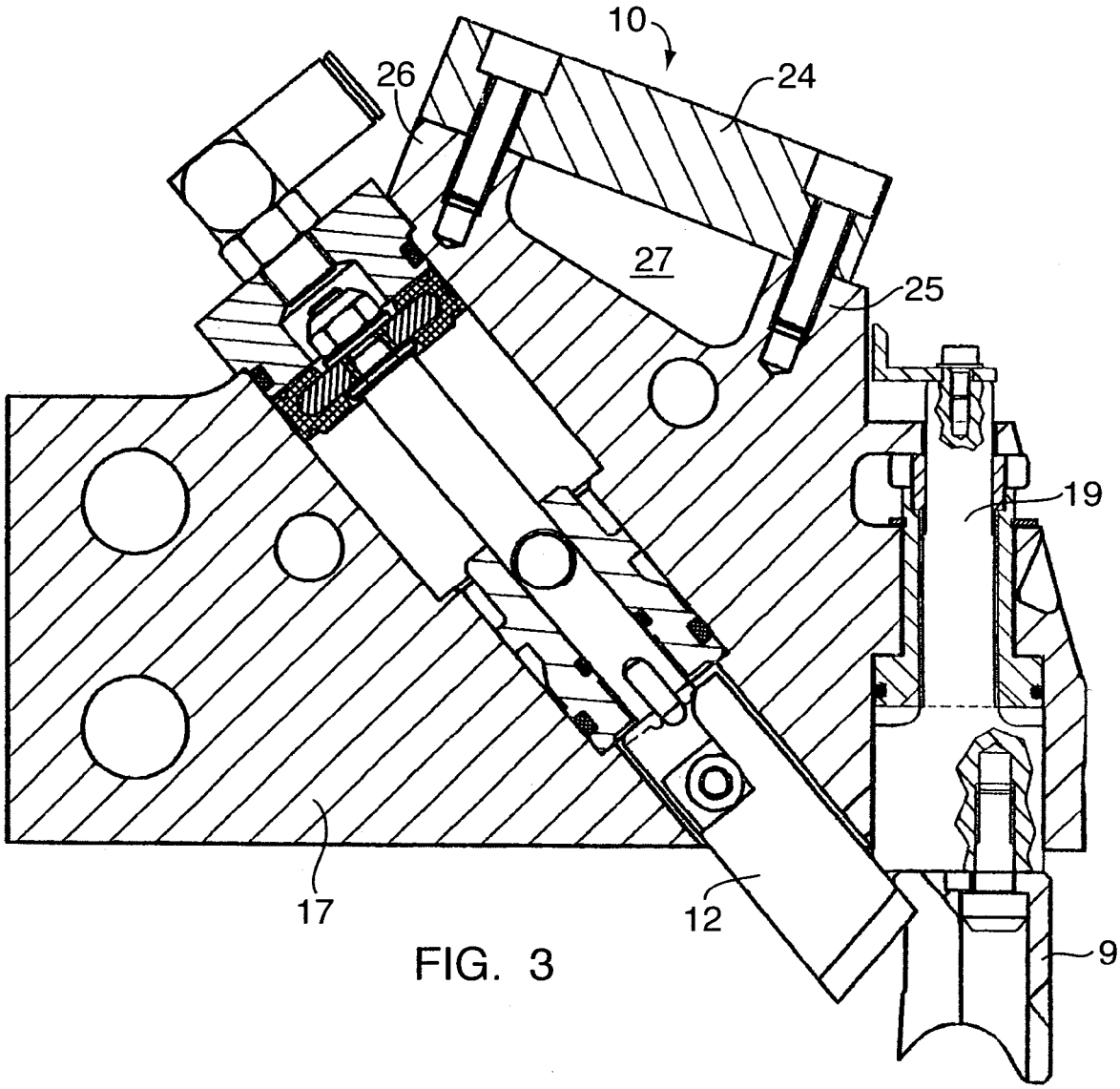
FIG. 3—a view of a portion of the upper arm with a further embodiment of the measuring device.

FIG. 3 shows another example of a measuring device 10, wherein the same reference numerals are used again for same parts. In this case, the measuring device 10 again preferably has strain measuring strips, which however are arranged in their own housing 24 whose deformation is measured. This housing can also contain a signal processor, which, for example, is fed to the control 4, as has already been mentioned. The housing 24 is, for example, fastened to two elements 25 and 26 of the upper arm 7, 17 by means of threaded bolts, so that the deformation of the upper arm transmits the deformation of the upper arm to the housing 24 and thereby likewise the dip force is measured. Between elements 25 and 26 is arranged a recess 27 to increase the deformation of the upper arm. The deformation of the housing 24 proportional to the dip force is measured and again transmitted to the control or, as the case may be, to an electronic circuit preceding the control. From this measured signal, the control again in the described way determines whether at least one boundary value has been reached or exceeded. The control can then in the described way influence the drive 2. With this example, the strain measuring strips can be quickly exchanged. After assembly, there then takes place a null setting or calibration with unloaded strain measuring strips.

Figure 4:
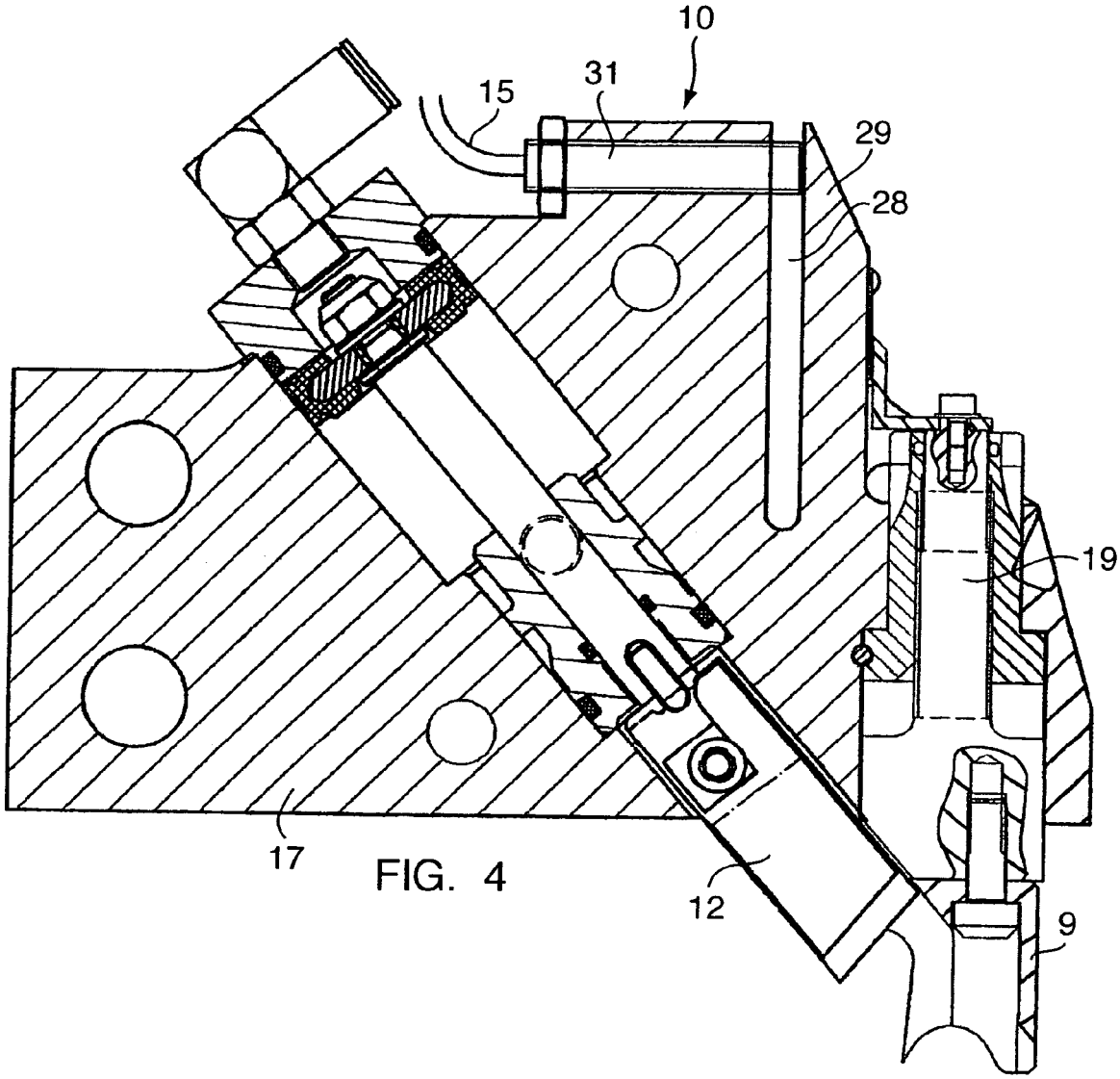
FIG. 4—a further view of a portion of the upper arm with a further embodiment of the measuring device.

FIG. 4 shows a further embodiment, where for the measurement of the clip force, the measuring device 10 includes a spacing sensor 31, which again is connected by way of a cable with the control 4 or with an intermediate electronic circuit for the signal processing. The spacing sensor 31 can be a capacitance spacing sensor which can measure small spacing changes of a prong 29 of the work tool holder or of the upper arm 17 relative to the forward face of the sensor 31. In this way, for example, spacing changes in the range of 0.01 mm are measurable. According to the effective dip force, the prong 29 moves toward the sensor 31 and upon unloading returns again. The prong is preferably formed by a recess 28 in a forward upper arm portion 17 itself, but can however also be a separate part fastened to the upper arm. By way of the measuring device one can then again determine whether the clip force reaches or exceeds one or more boundary values so that the dip apparatus can again be stopped in the described way by the control 4 and the drive 2.

The measurement of the clip force can also take place in other ways, in that, for example, a value of the drive can be determined which is likewise proportional to the clip force. In the case of a hydraulic machine drive, this value can be the hydraulic pressure. With the already mentioned electric machine drive, this measured value can be the motor driving current. It can however also be the turning moment on a shaft of the clip apparatus, for example, on the shaft 3'; or the bending moment at an axis, for example at the axis or pivot pin 33 carrying the lower arm 6 and the upper arm 7, 17. Also a direct force measurement, for example with a pressure measuring capsule, is possible. The selected measuring device will be correspondingly equipped, which for a person skilled in the art is possible within the frame work of his knowledge. Also in the case of these embodiments it is then determined whether the clip force reaches or exceeds one or more pre-established boundary values and that determination again is used to influence the machine drive.

While in the present application preferred embodiments of the invention have been described, it is to be dearly understood that the invention is not limited to these and that the invention can be carried out in other ways within the boundaries of the following claims.

The invention claimed is:

1. A clip apparatus for the closing of sausage-shaped packing casings by clips which are set and closed in a filling-free region of the casing, by a first work tool and a second work tool which are movable toward and away from one another in order to deform an open clip to a closed clip, the apparatus comprising a drive for moving the first work tool and the second work tool;

a control for controlling the drive; and a measuring device connected to the control for measuring an effective force between the first work tool and the second work tool, wherein the control compares the effective force to a first threshold value and to a second threshold value set higher than the first threshold value, and wherein the control is arranged to complete the closing of the clip and stop the drive at a predetermined end position when the effective force reaches the first threshold value, and the control is arranged to stop the closing of the clip and reverse the drive by a predetermined amount when the effective force reaches the second threshold value.

2. The clip apparatus according to claim 1, wherein the measuring device is arranged on one of an upper arm of the clip apparatus and a lower arm of the clip apparatus.

3. The clip apparatus according to claim 1, wherein the measuring device comprises at least one strain measuring strip arranged to measure a deformation of one of an upper arm of the clip apparatus and a lower arm of the clip apparatus.

4. The clip apparatus according to claim 3, wherein the strain measuring strip is arranged at a region of the upper arm or of the lower arm weakened by means of at least one recess.

5. The clip apparatus according to claim 3, wherein the strain measuring strip has a housing and is so arranged on the clip apparatus that the force leads to a deformation of the housing.

6. The clip apparatus according to claim 1, wherein the measuring device comprises a proximity sensor and a prong, arranged such that the nearness or remoteness of the prong to the sensor is dependent on the force.

7. The clip apparatus according to claim 1, wherein the drive comprises a drive shaft for moving the first work tool and the second work tool, and the measuring device as a measure of the effective force measures a turning moment of the shaft.

8. The clip apparatus according to claim 7, wherein the shaft carries an actuating cam for moving at least one of the first work tool and the second work tool.

9. The clip apparatus according to claim 1, wherein the first tool is mounted on an upper arm and the second tool is mounted on a lower arm of the apparatus, the upper and lower arms rotate about a pivot pin, and the measuring device as a measure of the effective force measures a bending moment of the pivot pin.

10. A clip apparatus for the closing of sausage-shaped packing casings by clips which are set and closed in a filling-free region of the casing, the apparatus comprising, a first work tool mounted on an upper arm of the apparatus and a second work tool mounted on a lower arm of the apparatus, the arms and the tools being movable toward and away from one another in order to deform an open clip to a closed clip;

a drive for moving the first work tool and the second work tool;

a control for controlling the drive; and a measuring device, connected to the control, by means of which a measure of an effective force between the first work tool and the second work tool is determined, wherein the control compares the effective force to a first threshold value and to a second threshold value set higher than the first threshold value, wherein the control is arranged to complete the closing of the clip and stop the drive at a predetermined end position when the effective force reaches the first threshold value, and the control is arranged to stop the closing of the clip and reverse the drive by a predetermined amount when the effective force reaches the second threshold value, and wherein the measuring device is arranged on the upper arm of the clip apparatus or on the lower arm of the clip apparatus and has at least one strain measuring strip with the strain measuring strip being arranged at a region of the upper arm or of the lower arm weakened by at least one recess.

11. A method for the closing of sausage-shaped packing casings by means of clips which are set and closed in a filling-free region of the casing, the method comprising moving a first work tool and a second work tool toward and away from one another in order to deform an open clip to a closed clip;

measuring an effective force between the first work tool and the second work tool;

comparing the effective force to a first threshold value and to a second threshold value set higher than the first threshold value; and moving the first and second work tools to complete closing the clip and stopping the moving of the first and second work tools at a predetermined position if the effective force reaches the first threshold value before the first and second work tools reach the predetermined position, and stopping the first and second work tools and moving the first and second work tools apart by a predetermined amount if the effective force reaches the second threshold value before the first and second work tools reach the predetermined position.

12. The method according to claim 11, wherein measuring the effective force comprises measuring a deformation of a holder for one of the first work tool and the second work tool.

13. The method according to claim 12, wherein the deformation measured is a bending of a holder part measured by a proximity sensor.

14. The method according to claim 12, wherein the deformation of a work holder part or of a work tool part is measured by strain measuring strips.

15. The method according to claim 11, wherein measuring the effective force comprises measuring a deformation of one of the first work tool and the second work tool.

16. The method according to claim 15, wherein the deformation measured is a bending of a work tool part measured by a proximity sensor.

17. The method according to claim 15, wherein the deformation of the work tool part is measured by strain measuring strips.

18. The method according to claim 11, wherein moving the first and second work tools comprises operating an electric drive, and wherein measuring the effective force comprises measuring an electrical value of the drive.

19. A method for the closing of sausage-shaped packing casings by means of clips which are set and closed in a filling-free region of the casing, the method comprising controlling a drive for moving a first work tool and a second work tool toward and away from one another in a normal operation to deform an open clip to a closed clip;

measuring an effective force between the first work tool and the second work tool;

comparing the effective force to a first threshold value and to a second threshold value set higher than the first threshold value; and moving the first and second work tools in the normal operation until the effective force reaches the first threshold value, then after the effective force reaches the first threshold value, moving the first and second work tools to complete closing the clip and stopping the moving of the first and second work tools at a predetermined position, and if the effective force reaches the second threshold value before the first and second work tools reach the predetermined position, then stopping the first and second work tools and moving the first and second work tools apart by a predetermined amount, wherein the measurement of the effective force is made by measurement of the deformation of a holder for at least one of the first work tool and the second work tool by means of strain measuring strips.

20. A method according to claim 19, further comprising providing a region adjacent the strain measuring strips which region is weakened by a recess, so that the effective force creates a readily measurable deformation (compression).

* * * * *